US005973458A

United States Patent [19]

Seo et al.

[11] Patent Number: 5,973,458

[45] Date of Patent: Oct. 26, 1999

[54] SEQUENTIAL FEEDBACK CONTROL SYSTEM FOR AN ELECTRONIC BALLAST

[75] Inventors: Maeng-Ho Seo; Nak-Choon Choi, both of Kyungki-do, Rep. of Korea

[73] Assignee: Samsung Electronics, Co., Ltd., Suwon, Rep. of Korea

[21] Appl. No.: 08/711,362

[22] Filed: Sep. 4, 1996

[30] Foreign Application Priority Data

Sep. 4, 1995 [KR] Rep. of Korea ..... 95-28758

[51] Int. Cl.[6] ..... H05B 37/02

[52] U.S. Cl. ..... 315/308; 315/DIG. 4; 315/DIG. 5; 315/149; 315/150; 315/360

[58] Field of Search ..... 315/308, DIG. 5, 315/DIG. 4, 291, 149, 150, 360

[56] References Cited

U.S. PATENT DOCUMENTS 4,791,338 12/1988 Dean et al. ..... 315/174

4,937,504 6/1990 Black, Jr. et al. ..... 315/307

5,726,534 3/1998 Seo ..... 315/97

*Primary Examiner*—Arnold Kinkead

*Attorney, Agent, or Firm*—Marger Johnson & McCollom, P.C.

[57] ABSTRACT

A sequential feedback control system for an electronic ballast provides feedback control during soft start and dimming operations. The system includes a feedback control portion that generates a feedback signal responsive to the power consumption of the ballast and receives a control signal for controlling the power consumption of the ballast. A dimming controller generates a dimming signal responsive to a time signal, and a soft start controller generates a soft start signal responsive to the time signal. An adder generates the control signal by adding the feedback signal and the dimming signal. The dimming controller includes a first resistor for setting the steady state power level during dimming operations and a second resistor for setting the rate of change of the power level.

13 Claims, 5 Drawing Sheets

SEQUENTIAL FEEDBACK CONTROL SYSTEM FOR AN ELECTRONIC BALLAST

This application corresponds to Korean Patent Application No. 95-28758 filed Sep. 4, 1995 in the name of Samsung Electronics Co., Ltd., which is herein incorporated by reference.

BACKGROUND OF THE INVENTION

1. Field of the Invention

This invention relates generally to feedback control systems for electronic ballasts and more particularly to a sequential feedback system which provides soft start and dimming control for an electronic ballast.

2. Description of the Related Art

Feedback control systems are used to control electronic ballasts because they provide effective control despite irregular characteristics of lamp loads, and because they are effective for reducing energy consumption and extending lamp life.

A sequential feedback control system that can implement soft start and dimming operations provides further benefits in terms of energy efficiency and extended lamp life. During a soft start operation, a lamp is driven at a reduced power level during a preheat cycle before the entering a discharge mode. This reduces the stress on the filament and extends the lifespan of the lamp. The power to the lamp is then increased until it enters a discharge mode. After a sufficient period during which the discharge is maintained, the power can be reduced during a dimming operation to adjust the brightness of the lamp commensurate with the ambient lighting conditions, thereby conserving power. A sequential control system employing feedback can adapt the power flow to the changing load conditions presented by a lamp as it is operated in the various modes.

A prior art feedback control system for an electronic ballast is shown in FIG. 1. An electronic ballast 12 drives a lamp 11 and generates a current consumption signal (ifb) which is indicative of the current consumed by the ballast. The current consumption signal (ifb) is multiplied with a direct link voltage signal (E) by multiplier 13 which generates a control current signal (imo) representative of the power consumption of the ballast 12. The direct link voltage signal (E) is converted into a direct link current signal (Ie) by a resistor (1/RL).

A resistance block (Rmo) converts the current signal into a voltage signal (Vmo) which is subtracted from a reference voltage signal (Vref) from a reference voltage generator 14 by an adder 15. The adder 15 generates an error signal (Verr) which is converted to an amplified current signal (Iin) by an error amplifier 16 having a transconductance (Gm). The amplified current signal (Iin) charges the capacitor (C) to generate an integrated voltage signal (Vin) which is changed into a integrated current signal (i1) by a voltage controlled current source (VCCS).

A second adder 18 subtracts the integrated current signal (i1) from the sum of the direct link current signal (Ie) and a standard current reference signal (Iref), thereby generating a composite current signal (it). The composite current signal (it) is used by an oscillator & output driver 19 to charge a capacitor (Ct) and generate a frequency signal (f1) which controls the power consumption of the electronic ballast (12).

Thus, the power input to the electronic ballast is controlled in a closed loop manner because the input power which is controlled by the frequency signal (f1) is proportioned to the current consumption signal (ifb).

Although the feedback control system of FIG. 1 is effective for maintaining the discharge of a lamp after it is initiated, it is difficult to adapt it to a sequential feedback control system that implements soft start and dimming functions.

Accordingly, a need remains for a feedback control system for an electronic ballast which overcomes the problems discussed above.

SUMMARY OF THE INVENTION

It is, therefore, an object of the invention to provide a feedback control system that is readily adaptable to sequenced operation for an electronic ballast.

Another object of the invention is to maintain feedback control of an electronic ballast while performing a soft start operation.

A further object of the invention is to maintain feedback control of an electronic ballast while performing a dimming operation.

One aspect of the present invention is a sequential control system for an electronic ballast comprising: a feedback control portion that generates a feedback signal responsive to the power consumption of the ballast And receives a control signal for controlling the power consumption of the ballast; a time controller that generates a time signal; a dimming controller coupled to the time controller, the dimming controller generating a dimming signal responsive to the time signal; and an adder coupled to the feedback control portion and the dimming controller, the adder generating the control signal responsive to the feedback signal and the dimming signal.

The system further includes: a soft start controller coupled to the time controller and the adder, the soft start controller generating a soft start signal responsive to a second time signal; and an adder that generates the control signal responsive to the feedback signal, the dimming signal and the soft start signal.

The dimming controller includes a first resistor that determines the level of the dimming signal during a steady portion of a dimming cycle and a second resistor that determines the rate at which the dimming signal changes during a sloping portion of the dimming cycle.

Another aspect of the present invention is a method for sequentially controlling an electronic ballast comprising: generating a feedback signal responsive to the power consumed by the ballast; generating a time signal; generating a soft start signal responsive to the time signal; generating a dimming signal responsive to the time signal; generating a control signal responsive to the feedback signal, the soft start signal, and the dimming signal; and controlling the power consumed by the ballast responsive to the control signal.

Generating the soft start signal includes: maintaining the value of the soft start signal at a level sufficient preheat a load connected to the ballast during a preheat cycle; and decreasing the value of the soft start signal to a level sufficient to cause the load to discharge during a discharge cycle.

Generating the dimming signal includes: increasing the level of the dimming signal during a sloping portion of a dimming cycle; and maintaining the value of the dimming signal at an appropriate value during a steady portion of the dimming cycle.

The foregoing and other objects, features and advantages of the invention will become more readily apparent from the following detailed description of a preferred embodiment of the invention which proceeds with reference to the accompanying drawings.

DETAILED DESCRIPTION OF THE PREFERRED EMBODIMENT

Figure 3:
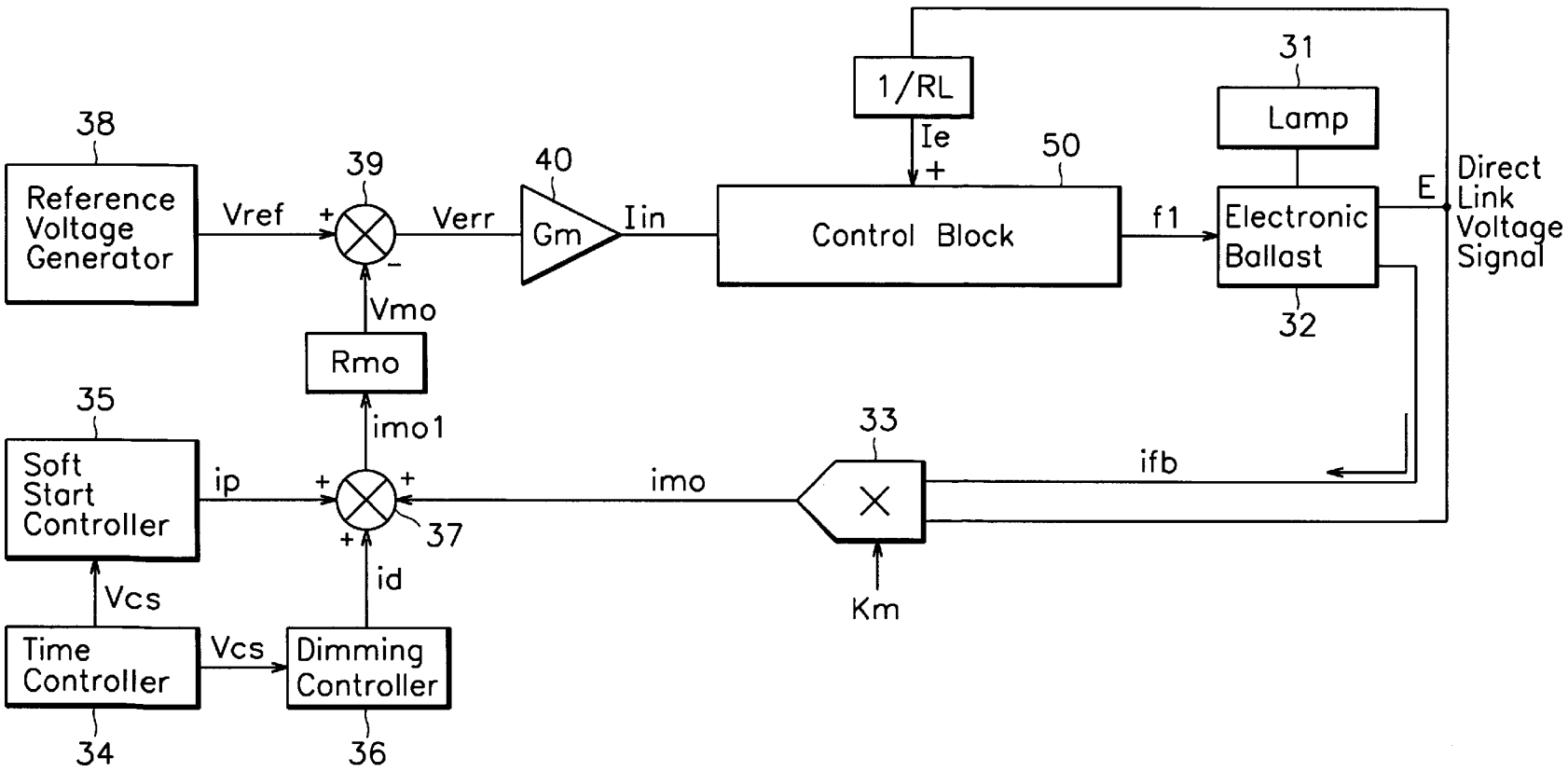
FIG. 3 is a block diagram of an embodiment of a sequential feedback control system in accordance,with the present invention.

An embodiment of a sequential feedback control system according to the present invention is shown in FIG. 3. Prior to describing the detailed structure of the system of FIG. 3, the key components of the circuit will be identified followed by a brief description of the operation of the system. Then a more detailed description of each of the components will be provided along with a more detailed description of the operation.

Referring to FIG. 3, the sequential control system includes a feedback controller portion having a control block 50, an electronic ballast 32, a multiplier 33, a first adder 39, a voltage reference generator 38 and a transconductance amplifier 40.

A sequence controller portion includes a second adder 37 which is connected between the multiplier 33 and the first adder 39. The second adder 37 is also connected to a dimming controller 36 and a soft start controller 35, both of which are connected to a time controller 34. Time controller 34 generates a first time signal Vcs1 which is received by the dimming controller 36 and a second time signal Vcs2 which is received by the soft start controller 35.

In operation, the adder 37 combines a soft start signal (ip) and a dimming signal (id) with the feedback signal (imo) to generate a control signal (imo1) which is used by the feedback controller portion to control the power consumption of the ballast commensurate with the level of the control signal (imo1). During a soft start operation, the soft start controller increases the current level of the soft start signal (ip) in response to the second time signal Vcs2. The increased current is added to the control signal (imo1) which, in turn, is subtracted from an error signal Verr, thereby reducing the power level supplied to the load by the ballast. Likewise, during a dimming operation, the dimming controller increases the current level of the dimming signal (id) in response to the first time signal Vcs1. The increased current is added to the control signal (imo1) which reduces the power level supplied to the load by the ballast.

More detailed consideration will now be given to the structure of the embodiment of the present invention shown in FIG. 3. The feedback controller portion includes an electronic ballast 32 which drives a lamp 31 and generates a current consumption signal (ifb) which is indicative of the current consumed by the ballast. The ballast is connected to a multiplier 33 which multiplies the current consumption signal (ifb) with a direct link voltage signal (E) thereby generating a control current signal (imo=Km*ifb*E) representative of the power consumption of the ballast 32. The direct link voltage signal (E) is also converted into a direct link current signal (Ie) by a resistor (1/RL) which is connected between the ballast 32 and a control block 50.

The feedback controller portion also includes a resistance block (Rmo) which is connected between the adder 37 in the sequence control portion and an adder 39 in the feedback controller portion. The resistance block (Rmo) converts the control current signal (imo1) from the sequence controller portion into a control voltage signal (Vmo). A reference voltage generator 38 is connected to the adder 39 and generates the reference voltage signal (Vref). The adder 39 generates an error voltage signal (Verr=VRef±Vmo) by subtracting the control voltage signal (Vmo) from the reference voltage signal (Vref).

The feedback controller portion also includes an error amplifier 40 which is connected to the adder 39 and has a transconductance (Gm). The error amp 40 converts the error voltage signal (Verr) into an amplified current signal (Iin). The control block 50 is connected to the error amp 40 and resistor (1/RL) and generates the frequency signal (f1) in response to the amplified current signal (Iin) and the direct link current signal (Ie).

Figure 4:
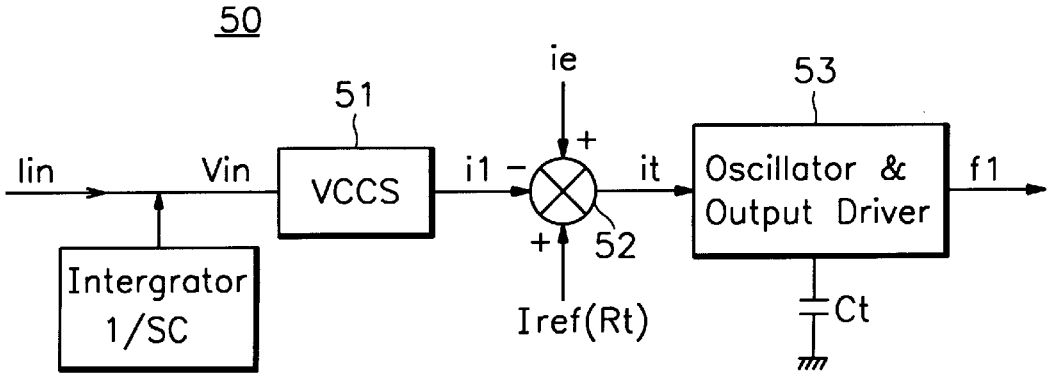
FIG. 4 is a block diagram of the control block of FIG. 3 in accordance with the present invention.

Referring to FIG. 4, the control block 50 includes an integrator (1/SC) which integrates the amplified current signal (Iin), thereby generating an integrated voltage signal (Vin). A voltage controlled current source 51 (VCCS) is connected to the integrator and converts the integrated voltage signal (Vin) into an integrated current signal (i1). Another adder 52 is connected to the voltage controlled current source 51 and resistor (1/RL) and subtracts the integrated current signal (i1) from the sum of the direct link current signal (Ie) and a standard current reference signal (Iref[Rt]), thereby generating a composite current signal (it=±i1±Iref±ie). The composite current signal (it) is used by an oscillator & output driver 53 to charge a capacitor (Ct) and generate a frequency signal (f1) which controls the power consumption of the electronic ballast 32.

Referring again to FIG. 3, the sequence controller portion includes a time controller 34 which generates a first time signal Vcs1 and a second time signal Vcs2. The soft start controller 35 is connected to the time controller and generates the soft start signal (ip) in response to the second time signal Vcs2. The dimming controller 36 is connected to the time controller and generates the dimming signal (id) in response to the first time signal Vcs1. The adder 37 which is connected between the multiplier 33 and the adder 39 of the feedback control portion. The adder 37 is also connected to the dimming controller 36 to receive the dimming signal (id) and the soft start controller 35 to receive the soft start signal (ip). The adder 37 generates the control current signal (imo1=imo±ip±id) by adding the feedback current signal (imo), the dimming signal (id) and the soft start signal (ip).

Figure 6:
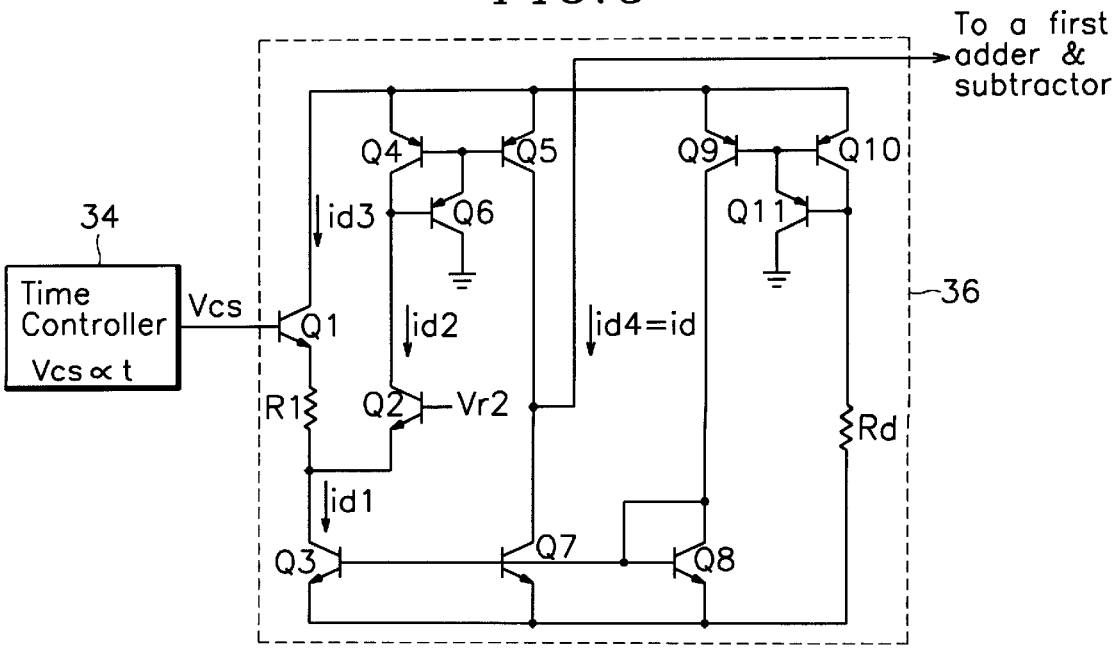
FIG. 6 is a detailed circuit drawing showing the structure of a dimming controller in accordance with the present invention.

Referring to FIG. 6, a dimming controller 36 in accordance with the present invention includes an input node for receiving the first time signal Vcs1 and an output node for outputting the dimming signal (id). A first current mirror, which generates a reference current (id1) that is determined by the resistance of a first resistor Rd, includes a pair of PNP transistors Q9 and Q10 having their emitters connected to a power supply node and their bases connected together. The collector of Q10 is connected to ground through resistor Rd. The collector of Q10 is also connected to the base of a PNP transistor Q11. The emitter of Q11 is connected to the bases of Q9 and Q10, and the collector of Q11 is connected to ground.

The first resistor Rd is preferably an optical sensor such as a photoresistor which changes resistance based on ambient lighting conditions.

The reference current Id1 is reflected through a second current mirror which includes three NPN transistors Q3, Q7 and Q8 which have their bases connected together, and their emitters connected to ground. The collector of Q8 is connected to its base and to the collector of Q9. The collector of Q7 is connected to the output node to output the dimming signal (id).

A differential amplifier is connected to the input node to receive the first time signal Vcs1 from the time controller. The differential amplifier includes an NPN transistor Q1 which has a collector connected to the power supply node, a base connected to the input node, and an emitter connected to the collector of Q3 through a resistor R1. The differential amplifier also includes an NPN transistor Q2 which has a base connected to a voltage reference source Vr2 and an emitter connected to the collector of Q3.

A third current mirror is coupled between the differential amplifier and the output node to shunt current from the output node, thereby controlling the dimming signal (id). The third current mirror includes a pair of PNP transistors Q4 and Q5 which have their emitters connected to the power supply node and their bases connected together. The collector of Q4 is connected to the collector of Q2 and the base of a PNP transistor Q6. The collector of Q5 is connected to the output node. The emitter of Q6 is connected to the bases of Q4 and Q5, while the collector of Q6 is connected to ground.

Figure 1:
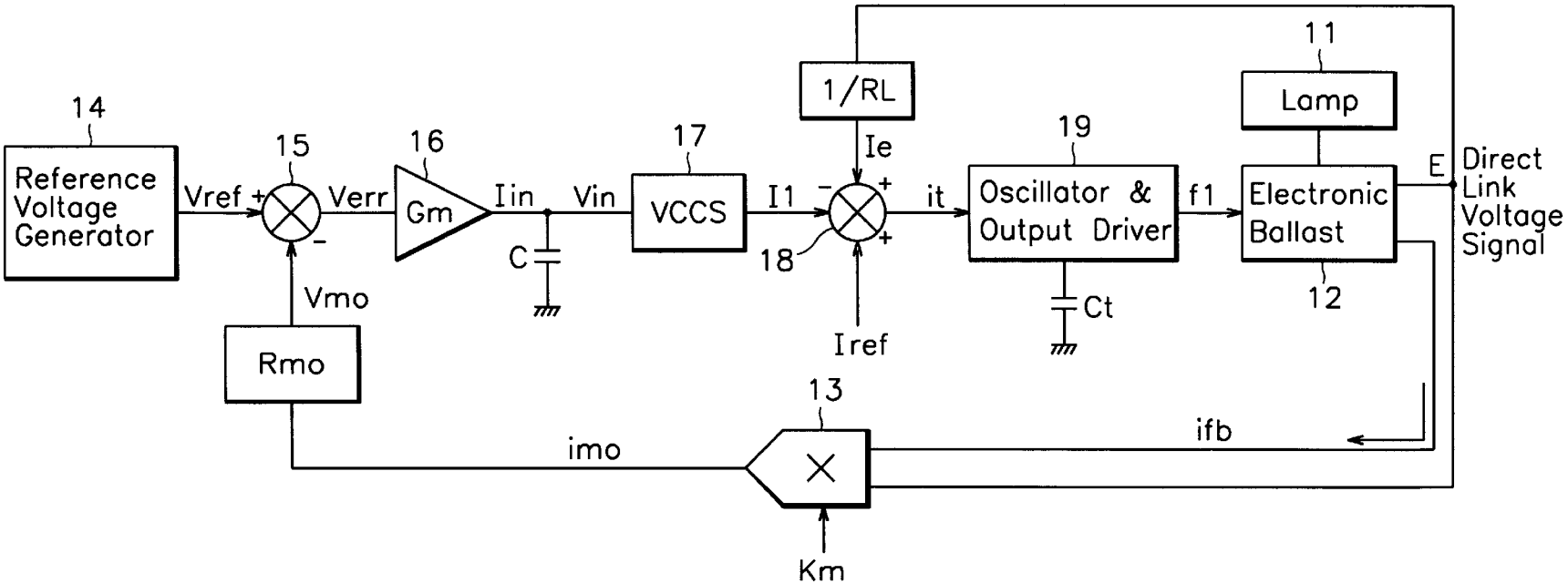
FIG. 1 (Prior Art)
FIG. 1 is a block diagram showing a prior art feedback control system for an electronic ballast.
Figure 2:
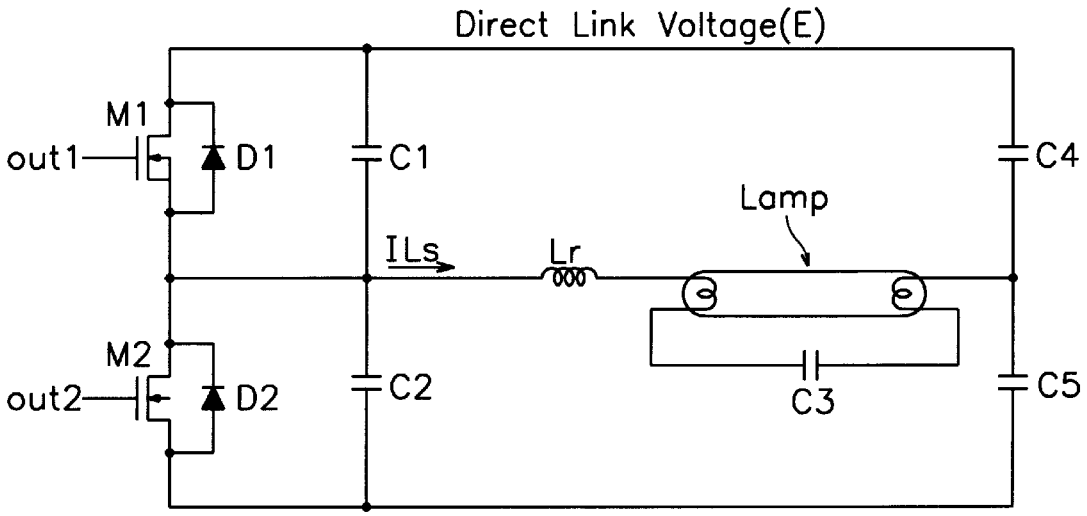
FIG. 2 is a schematic diagram of a prior art electronic ballast for use with the present invention.

Prior to describing the operation of the present invention, the operation of an electronic ballast for use with the present invention will be described. Referring to FIG. 2, a prior art electronic ballast 32 is a resonance type convertor in which the switching frequency is inversely proportional to the input power if the switching frequency is maintained a frequency that is higher than the LC resonance frequency of the combination of Lr and Capacitors-C1, C2, C3, C4, C5. Therefore, the switching frequencies during the preheating and dimming cycles (f, fd) must be twice as high as the frequency (f) in order to maintaining a discharge in the lamp.

Figure 5A:
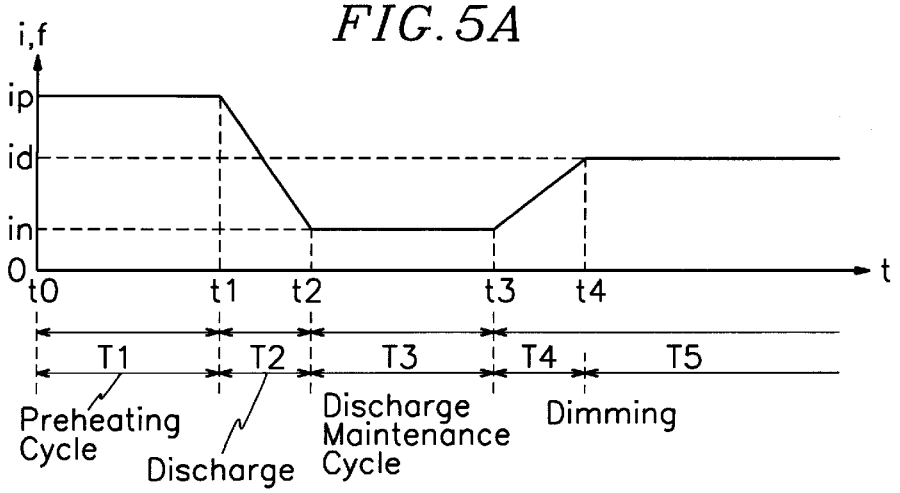
FIG. 5A is a graph showing current waveforms during soft start and dimming operations in a sequential feedback control system in accordance with the present invention.
Figure 5B:
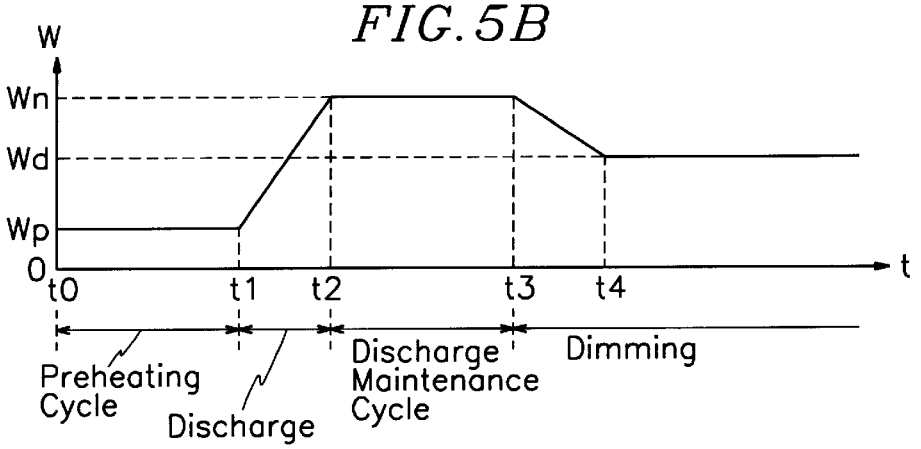
FIG. 5B is a graph showing power waveforms attained in a ballast controlled in accordance with the present invention.

More detailed consideration will now be given to the operation of the present invention. The operational sequence will first be described with reference to FIGS. 5A and 5B. During a preheating cycle T1, the current level of the soft start signal (ip) generated by the soft start controller is increased. This causes the control block to reduce the frequency of the frequency signal (f1) and thereby reduce the power consumption of the ballast to a level (Wp) which is adequate to preheat the filament. The lamp 31 is thus driven at a preheat power level at which no discharge occurs.

During a discharge cycle T2, the current level of the soft start signal (ip) decreases at a rate proportional to time, and the feedback control system responds by increasing the frequency (f1) and power consumption of the ballast to a level (Wn) adequate to initiate a discharge.

During a discharge maintenance cycle T3, the soft start signal (ip) drops to zero, and the feedback control system responds by maintaining the frequency (f1) and power consumption of the ballast at a level (Wn) adequate to maintain the normal maximum state of discharge.

During a sloping portion of a dimming cycle T4, the time controller 33 causes the dimming controller 36 to increase the level of the dimming signal (id) at a rate proportional to time. The feedback control system responds by reducing the frequency (f1) and power consumption of the ballast to a level (Wd) suitable for dimming the lamp.

During a steady portion of a dimming cycle T5, the dimming signal (id) is maintained at a steady level, and the frequency (f1) and power input to the ballast is maintained at an appropriate level.

The operation of the dimming controller 36 will now be described with reference to FIGS. 6 and 7. The current source formed by transistors Q9 and Q10 generates a reference current (id) that is determined by the resistance of Rd. The reference current is reflected to transistors Q3 and Q7 in the second current mirror. The voltage of the first time signal Vcs1 is initially at a low enough level to keep transistor Q1 off. Thus, transistor Q2 is on and the current id2=id1 since all of the current through Q3 passes through Q2. A third current mirror formed by Q4 and Q5 mirrors the current id2 through Q5. Thus, all of the current flowing through Q7 also flows through Q5, and no current flows through the output node. Therefore, id4=id3=0.

Figure 7:
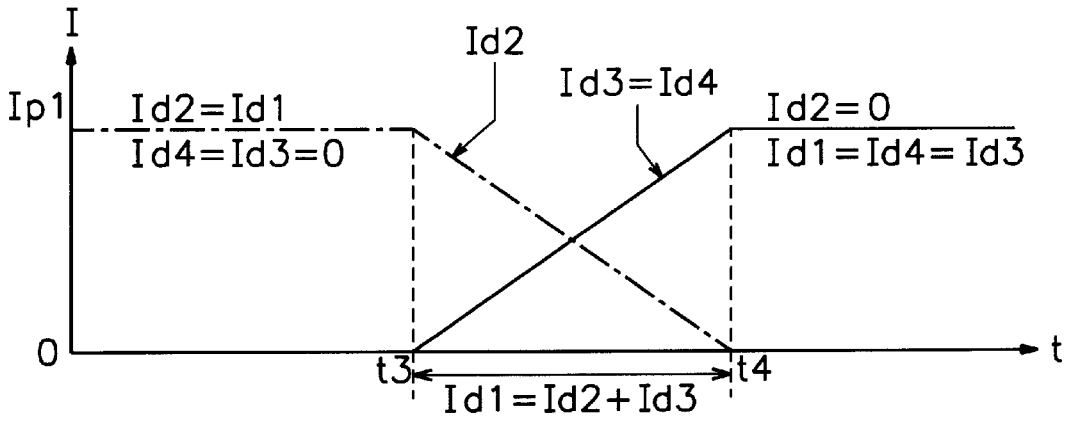
FIG. 7 is a graph showing current waveforms in a dimming controller in accordance with the present invention.

The voltage level of the first time signal Vcs1 then increases at a rate proportional to time until it reaches the level of Vr2 at time t3 in FIGS. 5 and 7. Transistor Q1 then begins to conduct a current id3, and the current id2 through Q2 decreases at a rate proportional to the rate of increase in id3. The decrease in id2 is reflected in transistor Q5, and thus, the current id4 though the output node will begin to increase accordingly until id4=id3=id1 at time t4 in FIGS. 5 and 7. The rate at which the current id3 increases is determined by the resistance of the second resistor R1. A larger resistor value results in a slower rate of increase.

If a photoresistor is used for the first resistor Rd, the dimming controller automatically adjusts the level of the dimming signal commensurate with the level of ambient light.

The operation of the oscillator & output driver 53 of FIG. 4 will now be described with reference to FIGS. 4 and 8. The current signal (it) from the adder 52 is proportional to the control frequency (f1) which can be expressed as a function of value of ΔV of the sawtooth waveform generated by the capacitor (Ct):

$$2*f1=it/(Ct*\Delta V) \quad \text{(Eq. 1)}$$

Figure 8:
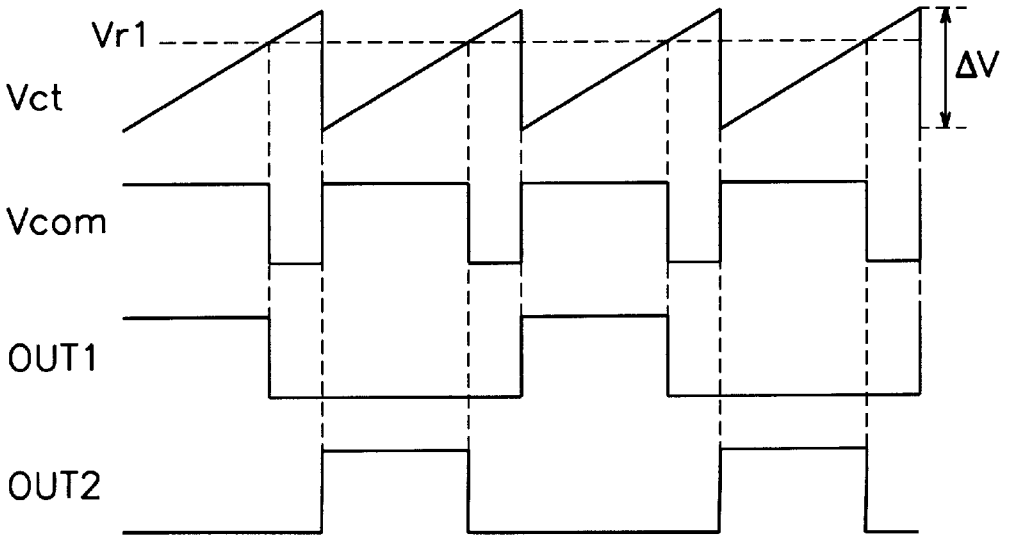
FIG. 8 is a graph showing waveforms for the oscillator & output driver illustrated in FIG. 4.

The oscillator & output driver 53 has dual outputs (out1) and (out2), and the frequency (f1) is half the value of the sawtooth wave frequency as shown in FIG. 8. Vct is the voltage waveform of capacitor (Ct) and Vr1 is an internal comparison voltage within the oscillator & output driver 53. The output of a comparator (not shown) which compares the comparison voltage (Vr1) to (Vct) is shown as Vcom. The output of the comparator is divided by first and second D flip-flops (not shown). The outputs from the flip-flops (OUT1) and (OUT2) alternately drive the electronic ballast 32.

One advantage of the present invention is that it allows for feedback control of an electronic ballast during sequenced operations. Another advantage of the present invention is that is provides for soft start operation of a ballast which extends the life of a lamp that is powered by the ballast. A further advantage of the present invention is that it allows for easy dimming of a feedback control system for a ballast, thereby increasing energy efficiency.

Having described and illustrated the principles of the invention in a preferred embodiment thereof, it should be apparent that the invention can be modified in arrangement and detail without departing from such principles. We claim all modifications and variations coming within the spirit and scope of the following claims.

We claim:

1. A sequential control system for an electronic ballast comprising:

a feedback control portion that generates a feedback signal responsive to the power consumption of the ballast and receives a control signal for controlling the power consumption of the ballast; and a sequence controller coupled to the feedback control portion to receive the feedback signal, the sequence controller generating the control signal to adjust the power consumption of the ballast at different times;

wherein the sequence controller includes:

a time controller that generates a first time signal and a second time signal;

a dimming controller coupled to the time controller, the dimming controller generating a dimming signal responsive to the first time signal;

a soft start controller coupled to the time controller, the soft start controller generating a soft start signal responsive to the second time signal; and an adder coupled to the feedback control portion, the dimming controller, and the soft start controller, the adder generating the control signal responsive to the feedback signal, the soft start signal, and the dimming signal.

2. A sequential control system for an electronic ballast comprising:

a feedback control portion that generates a feedback signal responsive to the power consumption of the ballast and receives a control signal for controlling the power consumption of the ballast; and a sequence controller coupled to the feedback control portion to receive the feedback signal, the sequence controller generating the control signal to adjust the power consumption of the ballast at different times;

wherein the sequence controller includes:

a time controller that generates a first time signal and a second time signal;

a dimming controller coupled to the time controller, the dimming controller generating a dimming signal responsive to the first time signal;

a soft start controller coupled to the time controller, the soft start controller generating a soft start signal responsive to the second time signal; and an adder coupled to the feedback control portion and the dimming controller, the adder generating the control signal responsive to the feedback signal and the dimming signal; and wherein the dimming controller includes an optical detector that adjusts the level of the dimming signal responsive to ambient light.

3. A sequential control system for an electronic ballast comprising:

a feedback control portion that generates a feedback signal responsive to the power consumption of the ballast and receives a control signal for controlling the power consumption of the ballast; and a sequence controller coupled to the feedback control portion to receive the feedback signal, the sequence controller generating the control signal to adjuster the power consumption of the ballast at different times;

wherein the sequence controller includes:

a time controller that generates a first time signal;

a dimming controller coupled to the time controller, the dimming controller generating a dimming signal responsive to the first time signal; and an adder coupled to the feedback control portion and the dimming controller, the adder generating the control signal responsive to the feedback signal and the dimming signal; and wherein the dimming controller includes:

an input node for receiving the first time signal;

an output node for outputting the dimming signal;

a first resistor that determines the level of the dimming signal during a steady portion of a dimming cycle;

a first current mirror coupled to the first resistor to generate a reference current that is determined by the resistance of the first resistor;

a second current mirror coupled to the first current mirror and the output node, the second current mirror generating the dimming signal;

a third current mirror coupled to the output node to shunt current from the output node; and a differential amplifier coupled to the input node, second current mirror and the third current mirror, the differential amplifier controlling the second current mirror responsive the first time signal received at the input node.

4. A sequential control system according to claim 3 wherein the first resistor is a photoresistor.

5. A dimming controller comprising:

an input node for receiving a first time signal;

an output node for outputting a dimming signal;

a first resistor that determines the level of the dimming signal during a steady portion of a dimming cycle;

a first current mirror coupled to the first resistor to generate a reference current that is determined by the resistance of the first resistor;

a second current mirror coupled to the first current mirror and the output node, the second current mirror generating the dimming signal;

a third current mirror coupled to the output node to shunt current from the output node; and a differential amplifier coupled to the input node, second current mirror and the third current mirror, the differential amplifier controlling the second current mirror responsive the first time signal received at the input node.

6. A dimming controller according to claim 5 wherein the first resistor is a photoresistor.

7. A dimming controller according to claim 5 wherein the dimming controller includes a second resistor that determines the rate at which the dimming signal changes during a sloping portion of the dimming cycle.

8. A dimming controller according to claim 7 wherein:

a first terminal of the first resistor is coupled to a ground node;

the differential amplifier includes:

a first transistor having a collector coupled to a power supply node, an emitter coupled to a first terminal of the second resistor, and a base coupled to the input node; and a second transistor having an emitter coupled to a second terminal of the second resistor, a base coupled to a comparison voltage signal; the third current mirror includes:

a fourth transistor having an emitter coupled to the power supply node, a collector coupled to the collector of the second transistor, and a base;

a fifth transistor having an emitter coupled to the power supply node, a collector coupled to the output node, and a base coupled to the base of the fourth transistor; and a sixth transistor having an emitter coupled to the base of the fourth transistor, a collector coupled to the ground node, and a base coupled to the collector of the fourth transistor; the second current mirror includes:

a third transistor having an emitter coupled to the ground node, a collector coupled to the emitter of the second transistor, and a base;

a seventh transistor having an emitter coupled to the ground node, a collector coupled to the output node, and a base coupled to the base of the third transistor; and an eighth transistor having an emitter coupled to the ground node, a base coupled to the base of the seventh transistor, and a collector coupled to its base; and the first current mirror includes;

a ninth transistor having an emitter coupled to the power supply node, a collector coupled to the collector of the eighth transistor, and a base;

a tenth transistor having an emitter coupled to the power supply node, a collector coupled to a second terminal of the first resistor, and a base coupled to the base of the ninth transistor; and an eleventh transistor having a emitter coupled to the base of the tenth transistor, a collector coupled to the ground node, and a base coupled to the collector of the tenth transistor.

9. A method for sequentially controlling an electronic ballast comprising:

generating a feedback signal responsive to the power consumed by the ballast;

generating a first time signal and a second time signal;

generating a control signal; and controlling the power consumed by the ballast responsive to the control signal;

wherein generating the control signal includes:

generating a dimming signal responsive to the first time signal;

generating a soft start signal responsive to the second time signal; and adding the dimming signal, the soft start signal, and the feedback signal; and wherein generating the dimming signal includes:

increasing a level of the dimming signal during a sloping portion of a dimming cycle; and maintaining the level of the dimming signal at an appropriate value during a steady portion of the dimming cycle.

10. A method for sequentially controlling an electronic ballast comprising:

generating a feedback signal responsive to the power consumed by the ballast;

generating a first time signal and a second time signal;

generating a control signal; and controlling the power consumed by the ballast responsive to the control signal;

wherein generating the control signal includes:

generating a dimming signal responsive to the first time signal;

generating a soft start signal responsive to the second time signal; and adding the dimming signal, the soft start signal, and the feedback signal; and wherein generating the dimming signal includes adjusting the dimming signal responsive to ambient light.

11. A method for sequentially controlling an electronic ballast comprising:

generating a feedback signal responsive to the power consumed by the ballast;

generating a first time signal;

generating a dimming signal responsive to the first time signal;

generating a control signal responsive to the feedback signal and the first time signal;

controlling the power consumed by the ballast responsive to the control signal; and generating a second time signal;

wherein generating the control signal includes:

generating a soft start signal responsive to the second time signal; and adding the dimming signal, the soft start signal, and the feedback signal.

12. A method according to claim 11 wherein generating the soft start signal includes:

maintaining a value of the soft start signal at a level sufficient to preheat a load connected to the ballast during a preheat cycle; and decreasing the value of the soft start signal to a level sufficient to cause the load to discharge during a discharge cycle.

13. A method according to claim 9 wherein increasing the level of the dimming signal includes:

generating a first current;

shunting the first current with a second current, thereby holding the level of the dimming signal at a low level;

generating a third current which increases at a predetermined rate; and reducing the second current at a rate proportional to the rate of increase of the third current, thereby increasing the level of the dimming signal.

* * * * *

UNITED STATES PATENT AND TRADEMARK OFFICE

CERTIFICATE OF CORRECTION

PATENT NO. : 5,973,458
DATED : October 26, 1999
INVENTOR(S) : Seo et al.

It is certified that error appears in the above-identified patent and that said Letters Patent is hereby corrected as shown below:

Column 8,
Line 3 "Adjuster" should read -- adjust --
Line 36, "a first time" should read -- a time --

Column 9,
Line 26, "a emitter coupled" should read -- a collector coupled --

Signed and Sealed this

Twenty-third Day of July, 2002

*Attest:*

*Attesting Officer*

JAMES E. ROGAN
*Director of the United States Patent and Trademark Office*